United States Patent [19]

Essek

[11] Patent Number: 4,959,878

[45] Date of Patent: Oct. 2, 1990

[54] INVALID BED

[76] Inventor: Christine Essek, 4733 W. Main Rd., Fredonia, N.Y. 14063

[21] Appl. No.: 377,957

[22] Filed: Jul. 11, 1989

[51] Int. Cl.[5] ..... A61G 7/00

[52] U.S. Cl. ..... 5/424; 5/425

[58] Field of Search ..... 5/93 R, 97, 100, 284, 5/424, 425, 428, 430, 512

[56] References Cited

U.S. PATENT DOCUMENTS

| | | | |
|---|---|---|---|
| D. 231,874 | 6/1974 | Weigel et al. | 5/100 |
| 2,059,240 | 11/1936 | Johnston | 5/100 |
| 2,336,454 | 12/1943 | Boren . | |
| 2,533,983 | 12/1950 | Weigle et al. | 5/93 R X |
| 2,607,928 | 8/1952 | Rocker et al. . | |
| 2,691,781 | 10/1954 | Pirone et al. . | |
| 2,738,523 | 3/1956 | Bryant | 5/425 |
| 3,093,838 | 6/1963 | Beasley | 5/100 |
| 4,017,917 | 4/1977 | Brown | 5/284 X |
| 4,641,387 | 2/1987 | Bondy et al. | 5/284 X |

FOREIGN PATENT DOCUMENTS

| | | | |
|---|---|---|---|
| 546053 | 6/1942 | United Kingdom | 5/93 R |

*Primary Examiner*—Michael F. Trettel

*Attorney, Agent, or Firm*—T. M. Gernstein

[57] ABSTRACT

An invalid bed includes a monolithic, one-piece base unit that has a support section and a rail section that extends above that support section for a height that is sufficient to prevent an adult patient to climb over the rails yet is low enough so the bed is stable. A door is hingeably attached to the base unit to permit ingress and egress of a adult.

5 Claims, 1 Drawing Sheet

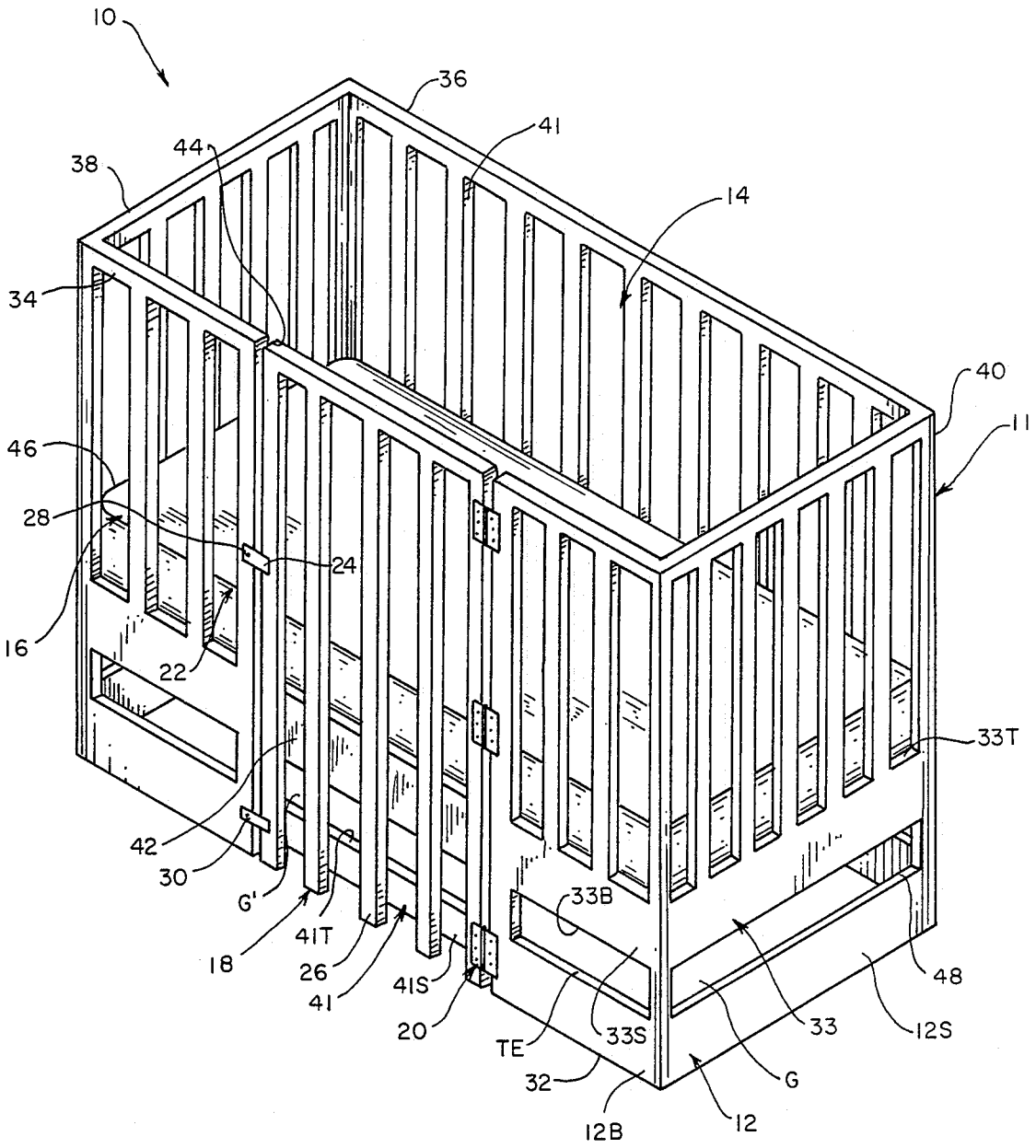
10
36
41
44
38
14
34
40
11
46
28
24
16
22
33T
42
30
G'
33B
41T
18
26
41
41S
20
TE
33S
33
48
12S
32
G
12B
12

INVALID BED

TECHNICAL FIELD OF THE INVENTION

The present invention relates to the general art of beds, and the to particular field of invalid beds.

BACKGROUND OF THE INVENTION

Due to many factors, such as cost, space availabilitY, care provider availability, and the like, many invalids are being cared for in the home. There have even been studies that conclude that a home environment is more conducive to convalescence than a hospital even though a hospital may be better equipped than a home.

However advantageous such home care is, it has several problems which places the home care option at a disadvantage to other options such as hospitalization and nursing home placement. One problem of particular importance is associated with a patient who may be prone to either falling out of bed accidentally or actually deliberately leaving the bed when he is supposed to remain bedridden. Such is the case with a person having a disease such as Alzheimer's disease or Cerebral Palsy and is mentally retarded yet has an adult body. Such an adult patient is prone to leaving his bed and wandering about thereby endangering himself and causing a problem for the person charged with his care. Such a patient should remain in bed when he is not being carefully watched.

While the art has examples of invalid beds having restraints such as straps and the like, such restraints restrict the movement of the patient and may be the cause of sores as well. Furthermore, applying such straps and the like to a patient may be quite difficult, especially if the patient does not want to be restrained. Accordingly, such devices are not totally desirable in all cases.

While many hospital beds have some sort of railing such railings are primarily intended to prevent a patient from accidentally falling out of bed, and are not adequate to restrain an adult patient in a bed if that patient is physically capable of getting out of bed.

These railed beds may also be difficult and onerous to change. Still further, the rails on invalid beds such as disclosed in U.S. Pat. No. 2,336,454 are intended to move out of the way, as by sliding or the like. While this feature is often helpful, it provides a means whereby the patient may find escape. While movable slats may be suitable for an infant's bed, in which the occupant is not likely to understand how to operate the slat or rail release or is not likely to have the hand dexterity to effect such release, rail or slat elements that are movable with respect to the rest of the bed may not be suitable for an adult patient. Thus, such sliding or movable rails are not suitable for some patients.

Accordingly, there is a need for an invalid bed that has means for physically preventing an adult-sized patient from getting out of that bed, yet does so without the use of difficult-to-use restraints.

OBJECTS OF THE INVENTION

It is a main object of the present invention to provide an invalid bed that has means for physically preventing an adult-sized patient from getting out of that bed, yet does so without the use of difficult-to-use restraints.

It is another object of the present invention to provide an invalid bed that has means for physically preventing an adult-sized patient from getting out of that bed, yet does so without the use of strap-type restraints.

It is another object of the present invention to provide an invalid bed that has means for physically preventing an adult-sized patient from getting out of that bed, yet does so without the use of difficult-to-use restraints yet is easy to service.

It is another object of the present invention to provide an invalid bed that has means for physically preventing an adult-sized patient from getting out of that bed, yet does so without the use of difficult-to-use restraints yet is easy to service and which has rails that cannot be moved.

SUMMARY OF THE INVENTION

These, and other, objects are achieved by an invalid bed that is monolithic and one-piece in construction and which includes a support section and a rail section mounted on top of the support section. A lockable door is mounted in the rail section to provide ingress and egress to the bed. The bed does not have any movable slats or rails and is monolithic and one-piece so that the slat or rail section is immovably fixed in place. The rail section extends a substantial distance above the support section whereby an adult will not be able to climb out of the bed without expending considerable effort, in fact, more effort than most of the invalids that can be expected to be in such bed will have. The height of the slat section is thus selected to achieve the goal of keeping an adult in the bed, yet without being so high as to make the bed unstable should the adult patient try to climb out of the bed. The height of the bed is selected so that the bed is not cumbersome to move and can fit through most home doorways.

This bed thus will provide an adequate, yet benign, restraint for an adult who is capable of getting out of the bed, yet for some reason, should remain bedridden. Because the base unit is monolithic and one-piece, the rails are immovable and are not susceptible to being removed or their restraining function vitiated by an adult patient. The size of the door and the bed are such that the sheets can be easily changed.

BRIEF DESCRIPTION OF THE DRAWING FIGURE

The single figure shows a perspective view of the invalid bed embodying the present invention.

DETAILED DESCRIPTION OF THE PREFERRED EMBODIMENT OF THE INVENTION

Shown in the figure is an invalid bed 10 that can be used for an adult patient. The bed 10 includes a monolithic, one-piece base unit 11 which has a support section 12 and a rail section 14 immovably fixed thereto and which extends in use upwardly from the support section. A mattress 16 is supported on a mattress supporting section (hidden in the figure), and a door unit 18 is hingeably connected to the rail section by hinges, such as hinge 20. A lock assembly 22 which includes a lock element 24 on monolithic, one-piece door 26, and a catch element 28 on the rail section are used to keep the door closed when desirable. A second lock assembly 30 is located near the bottom of the door unit and includes a lock element and a catch element whereby the door can be securely closed using a lock that is not accessible to a patient in the bed. By being monolithic and one-piece, the door 26 will not be susceptible to being moved to allow egress of a patient from the bed without being opened.

The rail section extends to a height of about thirty-six inches above the support section so that a patient will be restrained in a manner that will make it difficult to climb over the rail section, yet the bed will not be so high as to be unstable or difficult to move about. The support section extends to a height of about twenty to twenty-four inches above a floor on which a bottom 32 of a bottom rail 12B thereof rests. The bottom rail 12B also includes a top edge TE. The support section also includes a mid rail 33 which has a top edge 33T and a bottom edge 33B which is spaced above the bottom rail top edge to define a gap G between the bottom rail and the mid rail. The support section mid rail also includes an outer surface 33S which is co-planar with bottom rail outer surface 12S, with the vertical rails of the rail section 14 extending upward from the mid rail top edge. The bed is shown in the figure as being sized for a twin sized mattress, but could be sized for a double or twin or king size mattress or any other size mattress as suitable. In the preferred embodiment, the bed is thirty-nine inches wide as measured between front side 34 and rear side 36, and is seventy-six inches long as measured between head end 38 and foot end 40 to define a patient containing area 41 of seventy-six inches by thirty-nine inches, with the rail section completely surrounding and enclosing such patient containing area. The support section also includes a bottom strut 41 having a top edge 41T and an outer surface 41S that is spaced from the bottom rail outer surface 12S, as well as a mid strut 42 extending adjacent to the mid rail and spaced from the bottom strut to define a gap G' therewith.

A pad (partially show at 46) is included to further protect the patient. The door opening 44 is about thirty inches wide in the preferred embodiment to permit easy ingress and egress of an adult patient and to permit the sheets to be easily changed.

Various access openings, such as opening 48, are defined in the support section and permits the support section to serve as a storage area.

It is understood that while certain forms of the present invention have been illustrated and described herein, it is not to be limited to the specific forms or arrangements of parts described and shown.

I claim:

1. An invalid bed comprising:

A) a monolithic, one-piece base unit which includes (1) a support section having a bottom which rests on a floor and extends upwardly therefrom and which includes a door opening section defined therein, said support section enclosing a patient containing area, (2) a vertical rail section immovably fixed to said support section and extending in use upwardly from said support section to a top edge and having a height as measured from said support section to said top edge of at least about thirty-six inches and including a door opening section which is located adjacent to said support section door opening section, said vertical rail section completely surrounding and enclosing said patient containing area, (3) a mattress supporting section on said supporting section, (4) a bottom rail which engages the floor and includes a top edge and an outer surface, and (5) a mid rail which includes a top edge and a bottom edge which is spaced above said bottom rail top edge to define a gap between said bottom rail and said mid rail, an outer surface which is co-planar with said bottom rail outer surface, said vertical rail section extending upward from said mid rail top edge;

B) a bottom strut having a top edge and which includes an outer surface that is spaced from said bottom rail outer surface;

C) a mid strut extending adjacent to said mid rail and spaced from said bottom strut to define a gap therewith; and D) a door unit attached to said base unit and including (1) a monolithic, one-piece door element having a top which is co-planar with said vertical rail section top edge and a bottom which is located adjacent to the floor, said door element being mounted on said base unit to swing about a vertically oriented pivot to cover and uncover said vertical rail section door opening section and said support section door opening section, said door unit including a plurality of vertically oriented, horizontally spaced apart rails, (2) a plurality of hinges attaching said door element to said base unit, each of said hinges being attached to said vertical rail section and said hinges being spaced apart vertically with one hinge being located adjacent to the floor, a second hinge being located adjacent to said vertical rail section top edge, and a third hinge being located between said first hinge and said second hinge, and (3) two lock assemblies for locking said door element to said base unit, with one lock assembly being located adjacent to said door element bottom and a second lock assembly being located between said door element top and said door element bottom.

2. The bed defined in claim 1 further including a plurality of openings defined in said support section.

3. The bed defined in claim 2 wherein said support section extends to a height of about twenty to twenty-four inches above a supporting surface.

4. The bed defined in claim 3 wherein said patient containing area is about 76" by 39".

5. The bed defined in claim 4 wherein said door unit is about thirty inches wide.

* * * * *